US006564684B2

(12) United States Patent
Bascom et al.

(10) Patent No.: US 6,564,684 B2
(45) Date of Patent: May 20, 2003

(54) FIBER CHOPPER APPARATUS AND METHOD

(75) Inventors: Randall Clark Bascom, Wauseon, OH (US); Harold Miles Hendrickson, Delta, OH (US); Russell Donovan Arterburn, Athens, TN (US); Carlos Gilberto Santizo, Mansfield, TX (US); Emery Sidney Barber, Joshua, TX (US)

(73) Assignee: Johns Manville International, Inc., Denver, CO (US)

( * ) Notice: Subject to any disclaimer, the term of this patent is extended or adjusted under 35 U.S.C. 154(b) by 0 days.

(21) Appl. No.: 09/843,185

(22) Filed: Apr. 26, 2001

(65) Prior Publication Data

US 2001/0015118 A1 Aug. 23, 2001

Related U.S. Application Data

(62) Division of application No. 09/129,461, filed on Aug. 4, 1998, now Pat. No. 6,267,035.

(51) Int. Cl.[7] ..... B26D 1/62
(52) U.S. Cl. ..... 83/105; 83/913; 83/950
(58) Field of Search ..... 83/109, 105, 113, 83/913, 950, 436.6, 552, 436.1, 345–346, 349

(56) References Cited

U.S. PATENT DOCUMENTS 2,221,716 A * 11/1940 Morton ..... 83/913
2,675,908 A * 4/1954 Griset, Jr. ..... 83/950
2,862,350 A * 12/1958 King et al. ..... 83/913
2,982,163 A * 5/1961 Jorgensen ..... 83/913
3,241,195 A * 3/1966 Baer ..... 83/950
4,176,535 A * 12/1979 Elsner et al. ..... 72/10
4,528,050 A * 7/1985 Arther et al. ..... 156/62.4
4,551,160 A * 11/1985 Frailey et al. ..... 65/2
5,181,640 A * 1/1993 Vossen et al. ..... 83/109
5,773,745 A * 6/1998 Widmer ..... 83/346
6,076,442 A * 6/2000 Arterburn et al. ..... 83/13

* cited by examiner

*Primary Examiner*—Kenneth E. Peterson
*Assistant Examiner*—Omar Flores Sánchez
(74) *Attorney, Agent, or Firm*—Robert D. Touslee

(57) ABSTRACT

A chopper for chopping fibers or fiber strands having a back up roll and a blade roll containing blades that work against a peripheral surface of the back up roll and a method of using is disclosed. The chopper has a number of improved features for reducing the frequency of long fibers or long fiber strands and fuzz from getting into the chopped product. The chopper can have one or any combination of the improvements. The improvements include a strand guide located at least two feet up stream of the chopper, a first starting roll for starting a new strand that runs on a fluid bearing that can be adjusted to control the RPM of the first starting roll, a mount for a roll that runs against the peripheral surface of said back up roll, a strand guide insert for reducing fuzz generation and for preventing fuzz from getting into the product, and a deflector plate for catching and deflecting chopped strands thrown off the back up roll into a chopped strand product chute.

5 Claims, 8 Drawing Sheets

FIG. 1 (PRIOR ART)
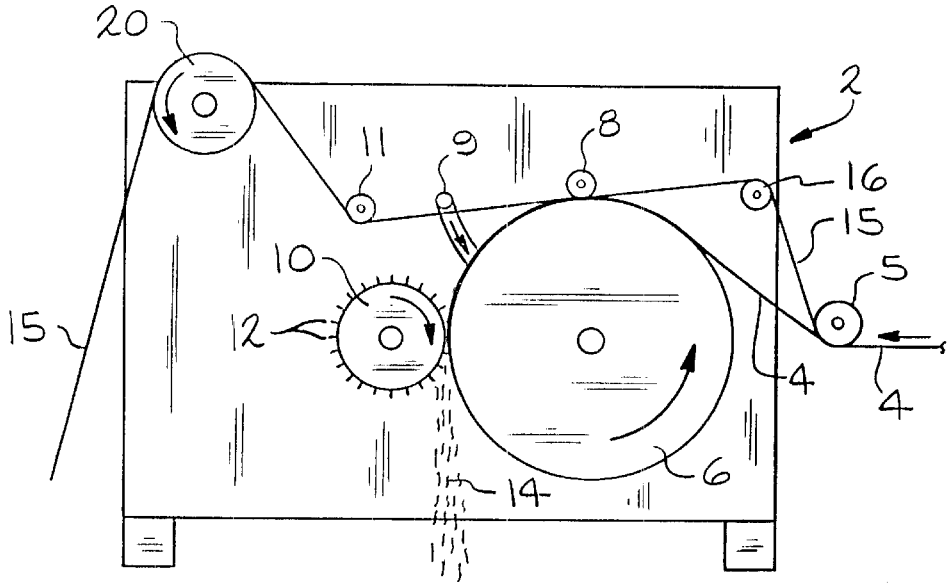
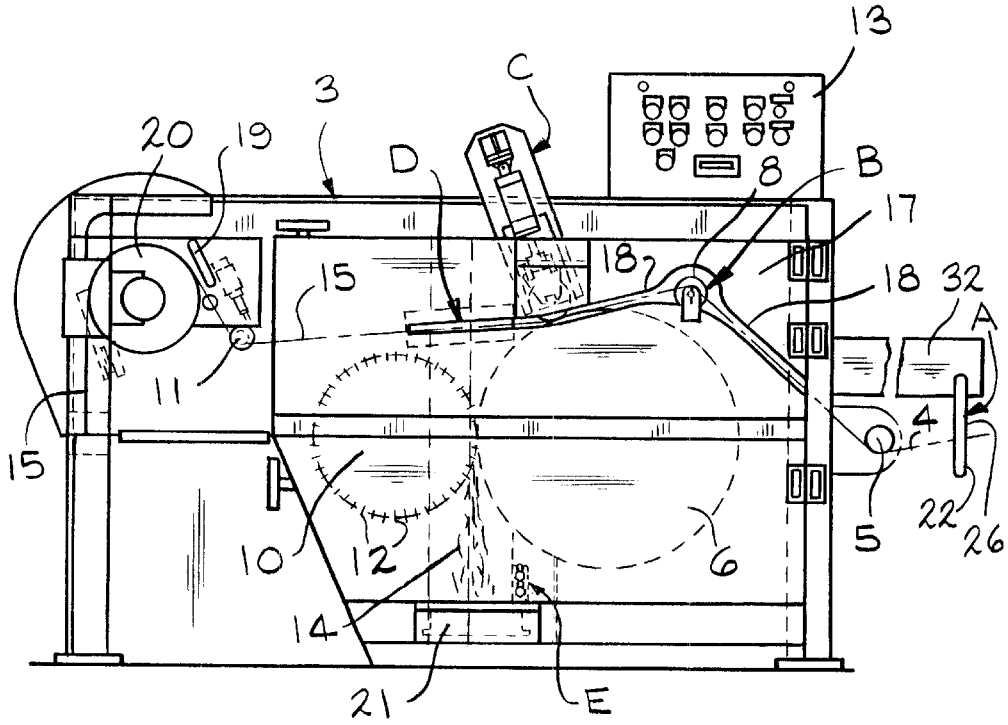
FIG. 2

FIG.6
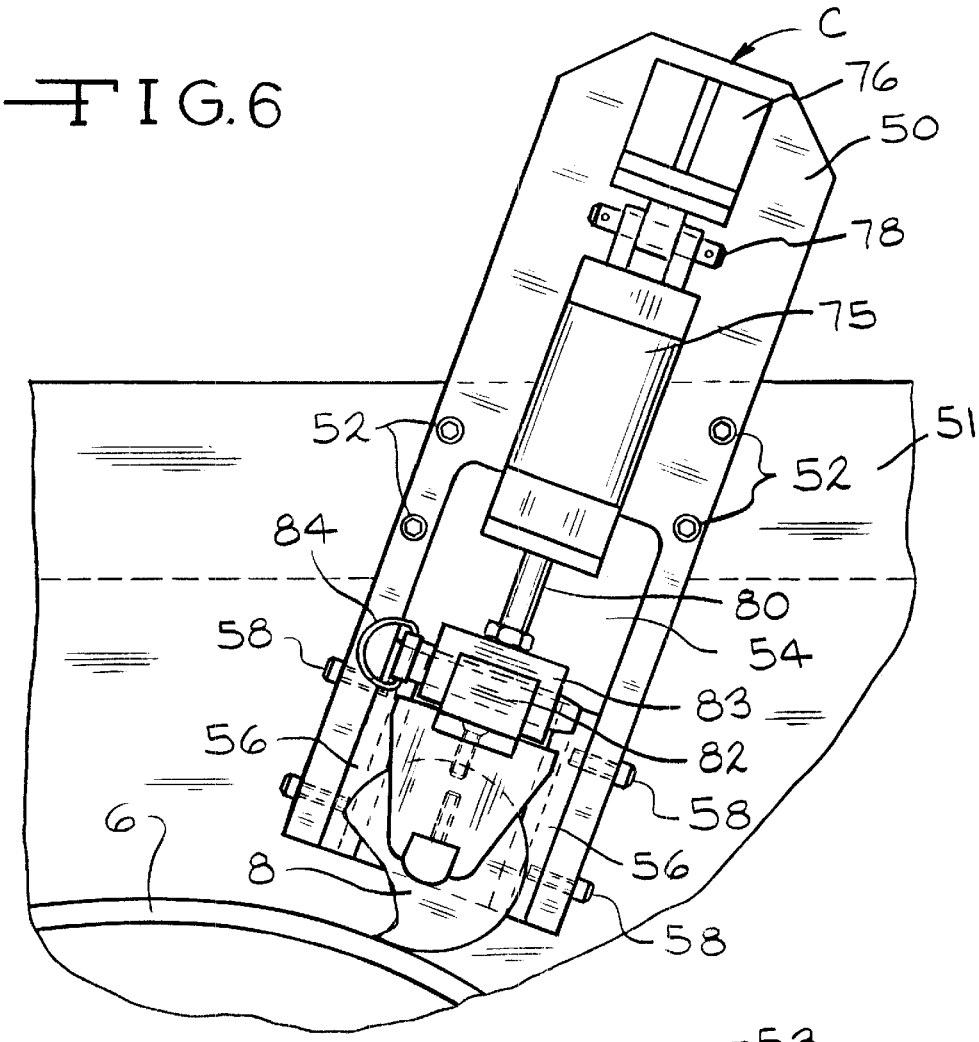
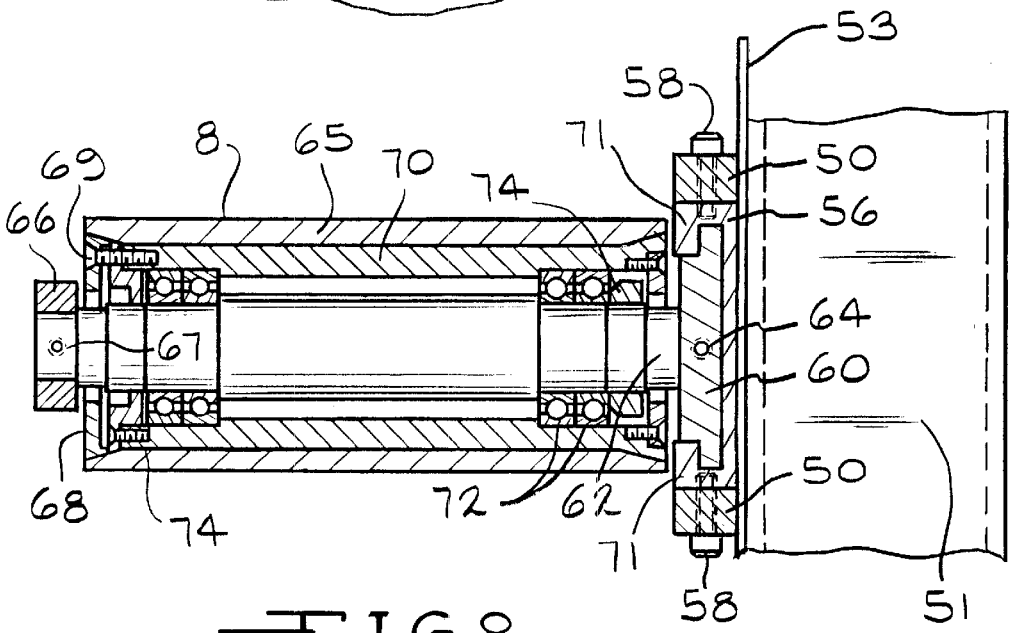
FIG.8

FIBER CHOPPER APPARATUS AND METHOD

This application is a division of U.S. application Ser. No. 09/129,461, filed Aug. 4,1998, now U.S. Pat. No. 6,267,035.

The present invention pertains to improvements of chopping apparatus for cutting fiber and strands of material such as mineral fiber including fiber glass, synthetic fibers including polyester or polyethylene and natural fibers including hemp and cotton, or for cutting ribbon like materials, and the method of using the improved chopper to make chopped products at high speeds of several thousand feet per minute. The apparatus is a vast improvement over the choppers used heretofore in that the improved chopper of the present invention greatly reduces and essentially eliminates stringers and fuzz in the chopped strand product and also reduces chopped fiber losses.

Chopped fiber and chopped strands are used in a number of different processes to make many useful products. They are mixed with many kinds of plastics and molded into a wide variety of parts and articles such as automotive parts and building parts. Chopped fiber and chopped strands are also made into dilute aqueous slurries and formed into nonwoven mats used to make roofing, flooring and automotive products and parts.

In processes of making chopped fiber of various kinds, a chopper receives continuously one or more strands made up of a plurality of fibers and chops the strand(s) into short lengths generally ranging from about ⅛ th inch to 3 or more inches long. The strand(s) are often moving very fast through the chopper, typically at several thousand feet per minute. One example of such a process is the process of making chopped glass fiber as disclosed in U.S. Pat. Nos. 3,508,461, 3,771,701, 3,815,461, 3,869,268, 4,175,939, 4,249,441, 4,347,071, 4,373,650, 4,398,934, 4,411,180, 4,551,160, 4,576,621, and 4,840,755, the disclosures of which are herein incorporated by reference.

Prior art choppers occasionally fail to cut completely all the strands passing through the chopper resulting in "stringers", fibers and strands of fiber that vary in length from a few inches to several feet. Also, fibers break and build up fuzz on parts of the prior art choppers and periodically break loose in clumps and go into the chopped product. A clump of fuzz is a tangled mass of one or more long fibers and since it won't disperse completely in the customers processes, most fuzz clumps may cause defects in the final products. The industry has tried for a long time to eliminate the stringer and fuzz problems and while the frequency has been reduced, at least at times, the problems remain serious and costly. Stringers and fuzz clumps, if present in the chopped strand cause costly defects in the products in which the chopped fiber and chopped strand are used.

Another problem with the prior art choppers is that they throw a very small percentage of good chopped fiber onto the chopper frame or onto the floor causing a housekeeping problem and reducing the material efficiency of the process. Attempts have been made to correct this problem with little or no success.

BRIEF SUMMARY OF THE INVENTION

A chopper assembly for which the improvements of the present invention apply includes a blade roll, a backup roll and a drive. The chopper assembly can also include an optional idler or puller roll for holding the fiber strands against the outer surface of the backup roll to keep the strands from slipping on the backup roll and reducing the pulling speed of the strands and causing undesirable fiber diameters and chopped lengths. The idler roll normally extends beyond the outer edge of the backup roll. The chopper assembly can also include an optional new strand starting system which includes a first starter roll or shoe, a starter bar, a second starting roll or shoe and an accelerating roll. A shoe is a U or V grooved roll or roll segment or a roll flanged on one end that either doesn't rotate, or if it does, at a very low surface speed or a roll that turns with a minimum resistance producing a surface speed similar to the moving strand in contact with the shoe. The shoes are typically made of low friction, long wearing materials like graphite, bronze or high density epoxy resin impregnated linen fabric composites like Micarta™.

The causes for the stringer and fuzz problems getting into the chopped strand products have now been discovered and solutions to these problems described above have now been developed. When fiberizing molten glass into fibers continuously from a heated precious metal bushing, a well known process, fibers break frequently just below the bushing. When one fiber breaks, very soon the rest of the fibers break and this creates a loose tail on the strand that is then pulled toward the chopper. It has now been discovered that these loose tails often do not get cut completely and end up in the product as stringers of various lengths from a few inches to several feet. It has also 'been discovered that the fuzz clumps are caused by one or more fibers being broken by a start up shoe and by sharp or rough edges of the protective guard covering the main working parts of the chopper.

The present invention includes a strand guide mounted upstream of the chopper and upstream from a strand separator roll or grooved oscillating roll as is well known, but down stream from a vertical projection of the closest fiberizer. This strand guide prevents the loose tail from swinging such that it would cause the strand to be thrown out of the strand separator roll and be pulled out of the nip between the blade roll and the back up roll or the chopper. The present invention also includes an improved starter shoe mounted on an air bearing and having a controlled rate of revolution (controlled resistance to rotation) which eliminates fiber breakage on the shoe and puts some tension into a new strand being started into the chopper to cause the strands to stay in the proper strand path.

The present invention also includes a new improved mount for an idler roll of the prior art choppers which allows for easy and fast removal and replacement of an idler roll assembly. This inventive mount, because of its improved structural integrity and integration of the components, also keeps the surface of the idler roll in better contact with the strands running on the back up roll and thus keeps the strands in the nip between the blade roll and the back up roll. The present invention also includes a strand guide insert for the protective cover guard for the working parts of the chopper which prevents the fibers from breaking and causing fuzz when a strand strikes an edge in an opening in the cover guard.

It has also been discovered that most of the good chopped strands thrown onto the floor of the fiber forming room by the chopper occurs because some chopped strands hang onto the peripheral surface of the backup roll for a fraction of a second and are then thrown off. The present invention also includes a deflector plate mounted in such a place that an edge of a deflector plate is kept very close to the peripheral surface of the back up roll and such that any chopped strands striking a working surface of the deflector plate will fall off into the flow of product. The deflector plate is preferably mounted in such a way that the top edge can be adjusted with respect to the peripheral surface of the backup roll while the chopper is operating.

BRIEF DESCRIPTION OF THE SEVERAL VIEWS OF THE DRAWINGS

FIG. 1 is a front view of a prior art chopper, with a vertically downward discharge of chopped product.

FIG. 2 is a front view of a chopper similar to the chopper of FIG. 1, but containing improvements A through E of the present invention.

FIG. 6 is a front view of improvement C, an improved mount for the idler roll.

FIG. 8 is a cross sectional view taken along lines 8—8 in FIG. 7.

DETAILED DESCRIPTION

Figure 3:
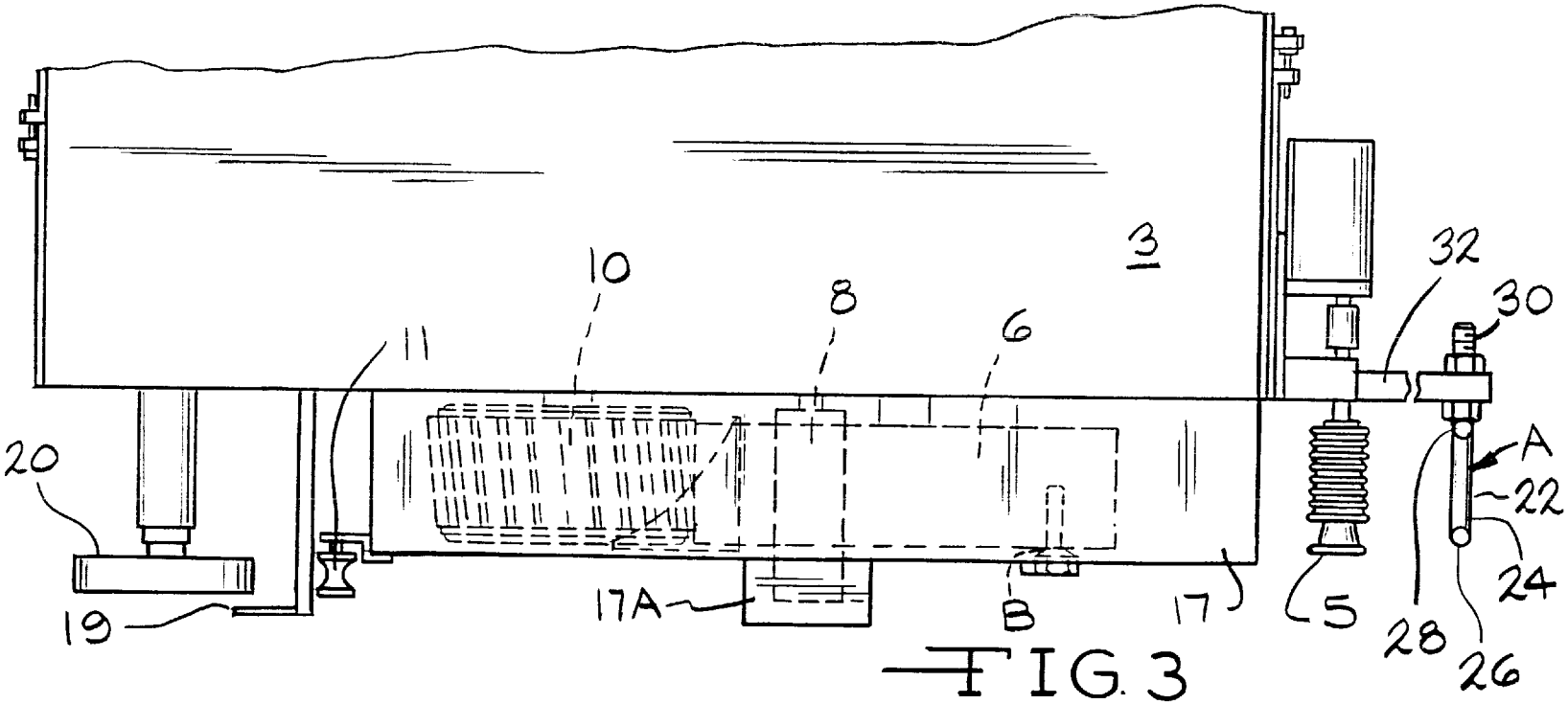
FIG. 3 is a plan view of the chopper and two of the improvements (A and B) shown in FIG. 2.

FIG. 1 shows a front view of a typical prior art chopper 2 used in making chopped glass fiber. Although the chopper will chop fibers and fiber strands of many different kinds of materials, glass fiber strands will be used for purposes of describing the invention. One or more, usually eight or more, glass strands 4, each strand containing 400–6000 or more fibers having water or an aqueous chemical sizing on their surfaces in a known manner, are pulled by a backup roll 6, in cooperation with an idler roll 8 having a knurled surface, into the chopper 2.

The strands 4 first run under a grooved separator roll 5 that can be oscillating some along its axis in a known manner, preferably with one strand in each groove, and upward and over the outer surface of the backup roll 6. The working surface of the back up roll 6 is typically made of polyurethane and is wider than the oscillating path of the glass fiber strands. The strands 4 then pass under a knurled idler roll 8 that is longer than the width of the back up roll 6. The idler roll 8 is pressed against the strands and the peripheral surface of the back up roll 6 at a desired pressure to enable pulling of the glass fiber strands 4. The strands 4 generally remain on the surface of the backup roll 6 and next pass into the nip between the backup roll 6 and a blade roll 10 having razor blade like blades 12 mounted therein, such as is shown in U.S. Pat. No. 4,249,441. The strands 4 are usually cleanly cut into chopped strands 14 having the desired length as the strands pass between the blade roll 10 and the back up roll 6.

The chopper 2 also has a system for starting a new strand 15. As is known, when a new strand is started, the fibers in the strand do not have the desired diameter until the strand is moving away from the fiberizer at the same speed that the other strands are running. If a new strand is put into the chopper path by the person starting the strand, two undesirable things will happen. Often the jerk on the strand caused by accelerating the strand from a few feet per minute to several thousand feet per minute instantaneously will break fibers coming from the fiberizer, causing what is called a false start or fiber break out. Each break out requires a new strand to be started again after the fiberizer has beaded down. But, even if the fiberizer doesn't break out, the diameter of the fiber in the first about 6–40 feet of the strand will be very large and out of specification. Therefore it is important to gradually and fully accelerate the new strand up to normal pulling speed before inserting the new strand into the chopper.

To accomplish this, typically when a new strand 15 is brought to the chopper, it is placed under an outermost portion of the oscillating roll 5, over a first starting roll 16, or fixed shoe, under an outermost portion of the idler roll 8, under a second starting roll or shoe 11 and over an accelerator roll 20, which is driven and is activated by the operator as the strand 15 is placed over the accelerator roll 20. The outermost portion of the oscillating roll 5 and the starter roll 16 are generally in the same plane, which plane lies outboard of the zone defined as between the planes lying at each end of the sharpened portion of the blades 12. The outer portion of the idler roll 8 and the starter bar 9 are also outside this zone, as is the second starting roll or shoe 11 and the accelerator roll 20 are inside this zone. The oscillating roll 5, or separator roll as it is sometimes called, is well known as can be seen in U.S. Pat. Nos. 3,771,701, 3,815,461, 4,048,861 and 4,551,160.

The accelerator roll 20 is normally in a stopped or non-rotating mode. As a new strand is laid over this roll, a switch is tripped by the operator causing this roll to begin to rotate slowly and to accelerate at a desired rate until its peripheral surface is moving at the pulling speed of the strands 4 to gently accelerate the new strand 15 up to the desired pulling speed. The new strand 15, after passing over and part way around accelerator roll 20, flies off the accelerator roll 20 and falls generally vertically through a hole in the floor to a scrap collector in the basement or into a scrap container (not shown) sitting by the chopper.

When the new strand 15 is running at the proper speed, a starter bar 9 moves downwardly in an arch path contacting the new strand 15 to move it into the zone or zones defined as between the planes formed by the ends of the sharpened edge of the blades 12 on the peripheral surface of the backup roll 6. With the action of the starting bar 9, the new strand 15 is pulled into a nip between the backup roll 6 and the blade roll 10 to cause the strand 15 to be chopped along with strands 4, to the chopping location at which time the new strand 15 is cut. The starting of the new strand 15 into the nip between the chopper blades 12 and the back up roll 6 can also be manually accomplished by moving the new strand 15 from the end portion of the separator roll 5 to the rear of the separator roll 5 and back to a desired running groove on the separator roll. This movement causes the new strand 15 to slide off of the first starter roll 16 onto the peripheral surface of the back up roll 6 at a location that causes the new strand 15 to move into the chopping nip. Once cut, that portion of the new strand 15 to the left of the nip is pulled away from the blade roll 10 by the accelerator roll 20. When the new strand 15 is cut, the accelerator roll 20 pulls the free end of the new strand away from the blade roll 10 and disposes of it into a scrap chute or onto the floor for disposal by the operator later. After a set period of time the drive to accelerator roll 20 is slowed down or shut down to await start up of the next new strand.

In accordance with the invention, FIG. 2 is a front view of a modified chopper 3 having a control panel 13 and a protective cover guard 17 with a slot 18 therein to allow the starting of new strands into the chopper. The cover guard 17 also has an idler roll cover guard 17A that projects out from the cover 17. This chopper 3 also has a flipper switch 19 mounted near the accelerator roll 20 that the operator activates when starting a new strand 15 to start the acceleration speed ramp control for the accelerator roll 20.

This chopper 3 is modified according to the present invention. The first modification is the addition of a strand guide A to keep a strand that has broken upstream of the strand guide A, usually at the fiberizer, from whipping out of the proper path and jumping out of the separator roll 5. This happens occasionally without the use of the strand guide A and can cause the whipping strand to move at least partly out of the nip between the back up roll 6 and the blades 12 of the blade roll 10 resulting in part of the strand not being chopped and ending up as a stringer in the chopped product 14. When the strand guide A is installed a few feet upstream of the separator roll 5, a strand with a broken end is kept in the proper path and is chopped properly along its length to the broken end.

Figure 4:
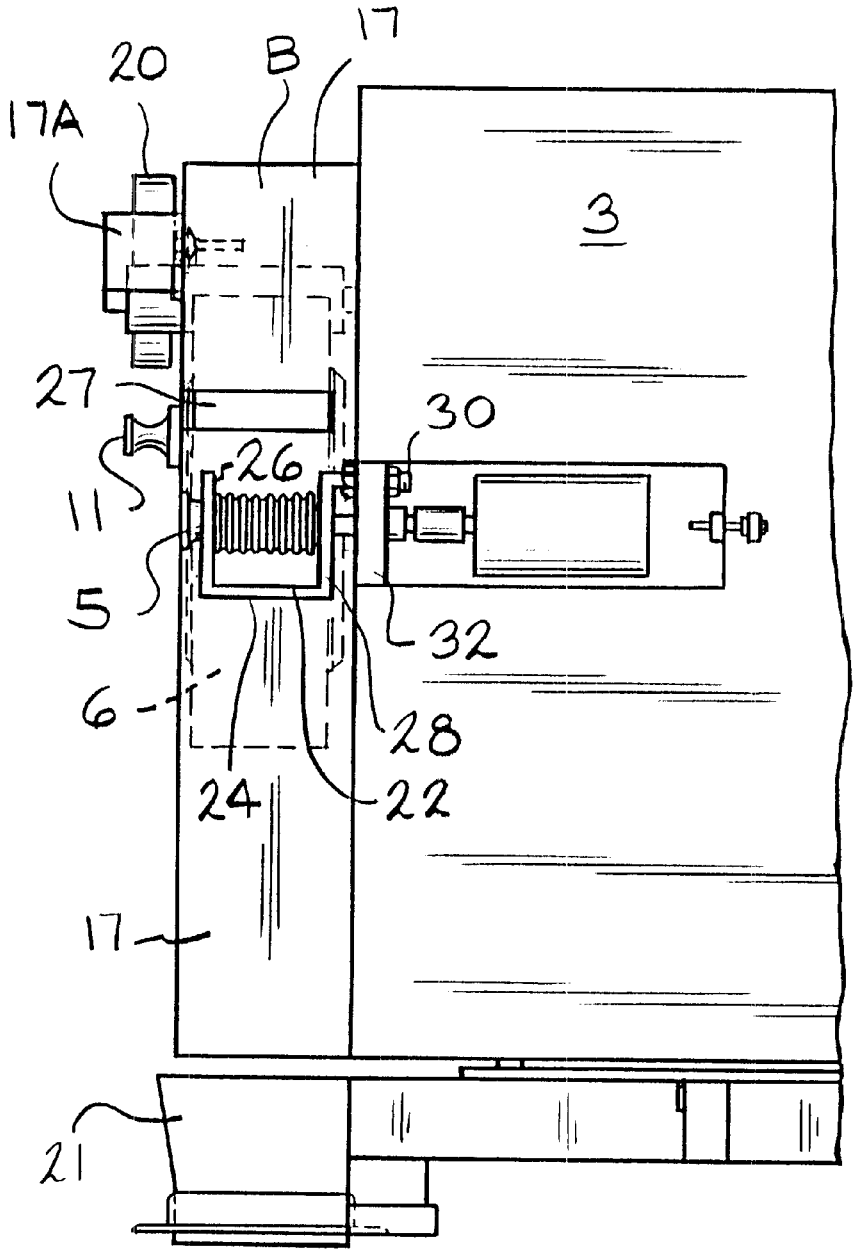
FIG. 4 is an end view of the chopper and the improvements A & B shown in FIG. 2.

In the embodiment shown in FIGS. 2–4 the strand guide A is a U shaped guide with a flat horizontal bottom section 24, an outboard upright section 26 and an upright inboard section 28, preferably integral with the bottom section 24. The upright inboard section 28 is preferably integral with a threaded horizontal section 30 that attaches to a frame member 32 that holds the strand guide A in a proper position. The shape of the strand guide A can be any shape that will hold the strands in the proper path for keeping the strand within the nip between the back up roll 6 and the blades 12, including a round bottomed U shape, a round bottomed V shape and a semi-circle shape. Preferably the strand guide is located at least about 2 feet upstream of the separator roll 5 or at least about 2–3 feet upstream of the upstream edge of the chopper 2. It is not necessary to restrain the strands from the top, leaving the strand guide A open at the top to easily feed a new strand into strand guide A, the separator roll 5 and on into the chopper 2 as described above.

Referring to FIGS. 2–5 the next improvement according to the present invention is shown as B. On the prior art choppers a first starting roll or fixed shoe 16 was used. The roll was mounted on ordinary bearings and the fixed shoe didn't rotate. Micarta™ or brass were typically used for both. It has been discovered that when a new strand is started with either one of these starter devices 16 and the new strand is accelerated up to normal running speed, the new strand moves faster than the surface of the first starter roll 16 even when the first starter roll 16 is mounted on bearings. This differential movement causes one or more fibers to break and generate fuzz in the chopper. The fuzz builds up into clumps, breaks loose and often is pulled into the good product by the running strands 4. Often these fuzz clumps, made up of tangled long fibers, causes defects in the products in which the chopped strand product is used.

To reduce the differential movement of the first starter roll 16 and the accelerating new strand 15, the first starter roll 16 was provided with an air bearing which allowed the first starter roll 16 to accelerate faster, reduced the differential and greatly reduced fuzz, but caused a new intolerable problem, roll wrap. The first starting roll 16 turned too fast causing the strand to follow the surface of the first starter roll 16 resulting in the strand wrapping around and around the first starter roll 16. When this happens, it aborts the starting of a the new strand and requires the operator to clean the wrapped strand off the roll 16 which is very time consuming. During that time the operator is unable to tend to other duties and the fiberizer is unproductive. Thus the air bearing was impractical even though it solved the fuzzing problem.

Figure 5:
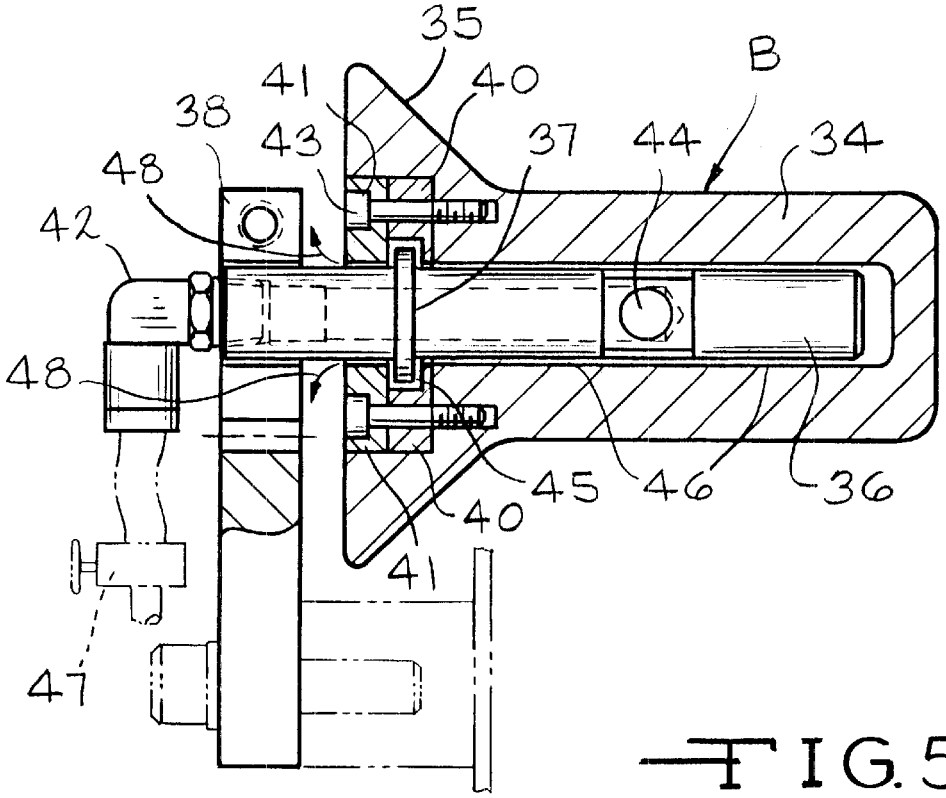
FIG. 5 is a cross sectional view of improvement B, an improved starting roll mounted on an air bearing and containing a feature that, with manipulation of the air flow through the bearing, controls the RPM of the starting roll to eliminate fuzz clumps.
Figure 9:
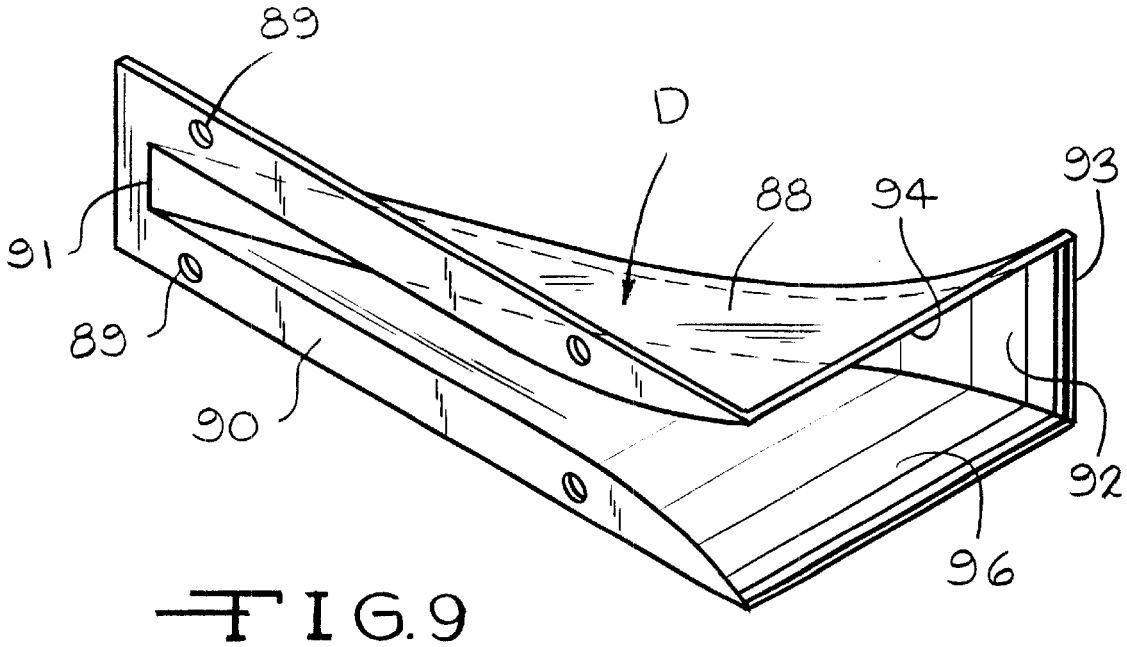
FIG. 9 is a perspective view of improvement D, a strand guide insert, for attachment to a protective cover guard for the working parts of the chopper.

The present invention B, an improved first starting roll, is based on the discovery that if a roll 34 (FIG. 5) is mounted on an air bearing modified to permit adding friction to reduce and control the RPM of the roll 34, the fuzz problem from the first starter roll 34 is eliminated or reduced to an acceptable level and yet the roll 34 does not roll wrap with the new strands being started. The modified first starter roll B of the present invention is shown in FIG. 5. The first starter roll 34 is made of the same material and has the same kind of surface as the prior art starter roll 16. The first starter roll 34 is mounted on a stainless steel shaft 36 having been bored out along its axis for at least one half of its length starting from the flared end of the roll or the end connected to a compressed air line and is rigidly mounted to a chopper frame member 38. The rear end of the shaft 36 is attached to a compressed air line 42 and the shaft 36 has two outlet holes 44 about midway between the shoulder 37 and an end of the shaft opposite the end connected to the air line 42 to allow the compressed air to enter the gap or clearance 46 between the shaft 36 and the interior of the roll 34. The preferred clearance 46 is about 0.001–0.002 inch. The compressed air line 42 is equipped with a conventional pressure regulator (not shown) and a conventional needle valve 47.

The shaft 36 has a raised shoulder 37 that is preferably an integral part of the shaft 36. The raised shoulder 37 cooperates with a stainless steel first keeper ring 40, a second keeper ring 41 and bolts 43 to retain the roll 34 on the shaft 36 and to also provide a controlled amount of friction to control the surface speed of the first starter roll 34. The clearance 45 between the raised shoulder 37 and the adjacent portions of the first and second keeper rings 40 and 41 is preferably about 0.010 to 0.015 inch.

To operate the improved first starter roll 34 the air pressure is preferably set at about 80 psi with a conventional pressure regulator, but other pressures can be used. The compressed air enters the clearance gap 46 through holes 44, on opposite sides of the shaft 36. The compressed air flows along the clearance 46 towards the raised shoulder 37, around the raised shoulder 37 and exits at the back of the roll 34 at 48 as indicated by the arrows. Each roll 34 on each chopper 3 must be set up and adjusted individually to work properly, and must be occasionally fine tuned.

This tuning is preferably accomplished using the conventional needle valve 47 in the compressed air line 42. The needle valve 47 is first set to an approximate correct flow rate of compressed air by the operator. The chopper is then operated in the normal way with close observation of the start up for roll wrap or for fuzz generation. If the starter roll 34 is roll wrapping or tending to roll wrap, the needle valve 47 is opened slightly to increase the air flow. When new strands are started air flow along the shaft 36 apparently pushes the shoulder towards the keeper ring 41 increasing friction which causes the starter roll 34 to run slower during the starting of a new strand 15. If fuzz is being generated instead of roll wrap, the air flow is cut back some using the conventional needle valve 47. This is repeated by the operator or process tech. until the starter roll is cleanly chopping without indications of fuzz from the first starter roll 34 or without indications of a tendency to roll wrap. The fine tuning of the resistance to rotation of the first starting roll 34 can be accomplished with a needle valve alone, a pressure regulator alone or preferably by using both together as disclosed above.

The next improvement of the present invention is shown at C in FIG. 2 and is an improved mount for the idler roll 8 which retains the feature of keeping the contact line of the surface of the idler roll 8 parallel with the surface of the back up roll 6, but with an improved structure that integrates the various components into a one integrated sub-assembly which retains the feature of ease and speed of changing the idler roll 8 when it becomes worn or when a bearing fails. The idler roll 8, by being pressed against the running strands 4 on the back up roll 6, is what pulls the running strands 4. Therefore, it is important that the idler press against each strand about equally to prevent slippage and/or to avoid causing one or more strands to fly away or depart tangentially from the peripheral surface of the back up roll 6 downstream of the idler roll 8. Since the backup roll might develop a slight taper across its width with wear or dressing during its life, it is important for the idler roll 8 to be able to pivot slightly as this happens to maintain uniform contact and force on the running strands 4. Since the surface of the idler roll 8 wears and because its internal bearings fail occasionally, the idler roll 8 and assembly has to be removed frequently and replaced. Since an entire leg of production is being scrapped while this replacement is happening, it is important that the apparatus allow this to be done quickly in addition to maintaining proper alignment. The prior art idler roll 8 mount was lacking in structural integrity, requiring multiple mounting components.

Figure 7:
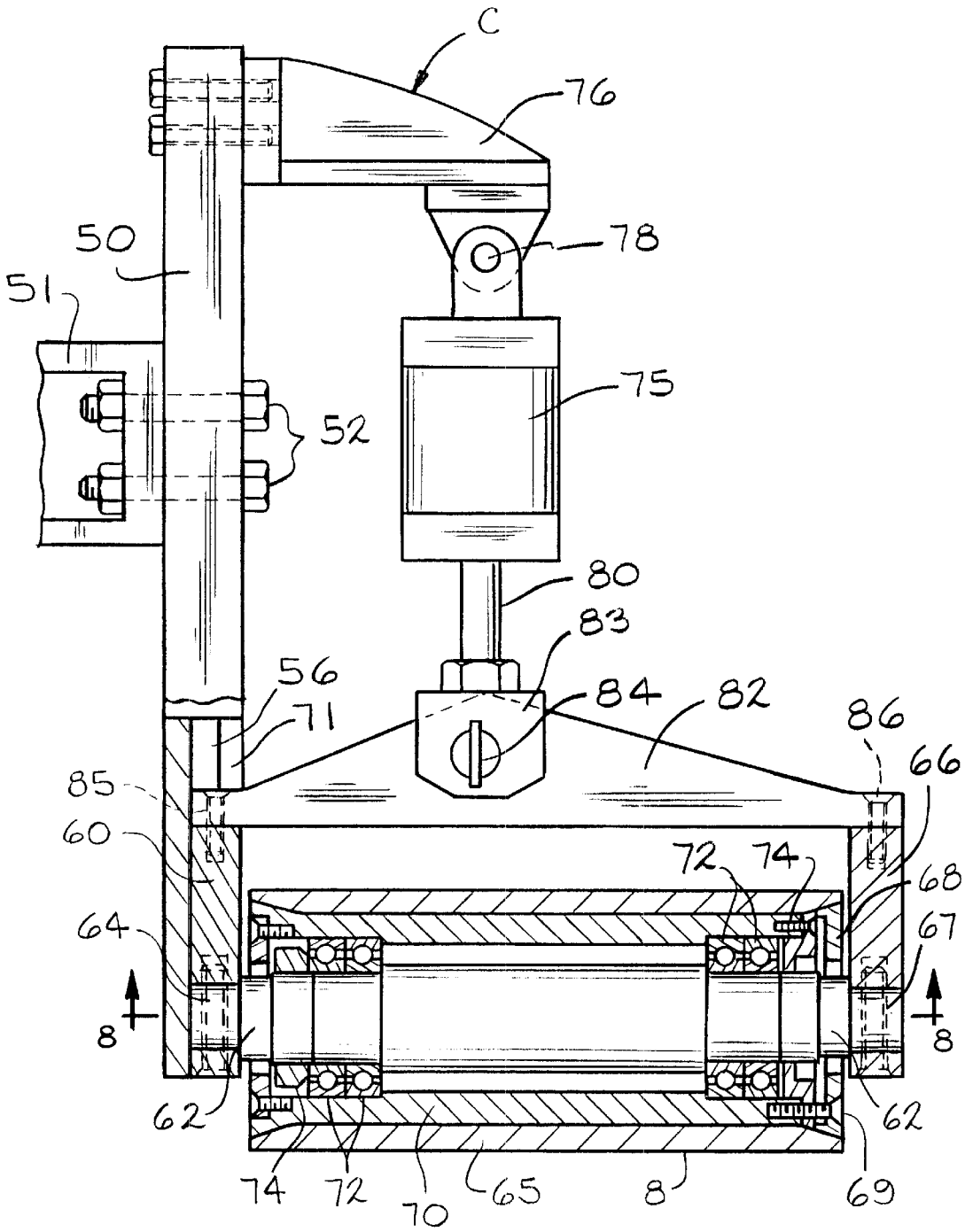
FIG. 7 is a side view of the idler roll and the improved idler roll mount shown in FIG. 6 with the idler roll and lower portion of the mount being shown in cross section.
Figure 10:
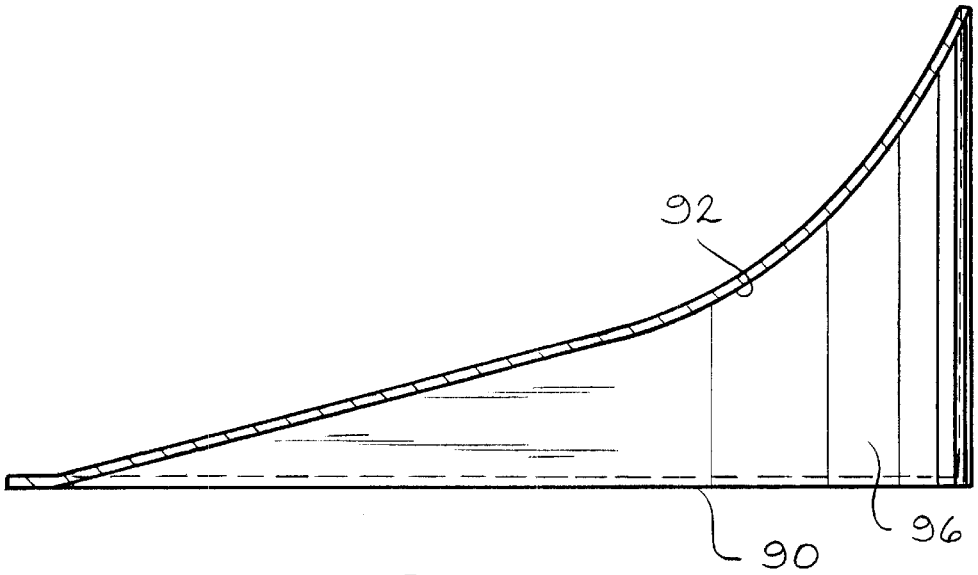
FIG. 10 is a cross sectional view of the strand guide insert taken along lines 10—10 in FIG. 11.
Figure 11:
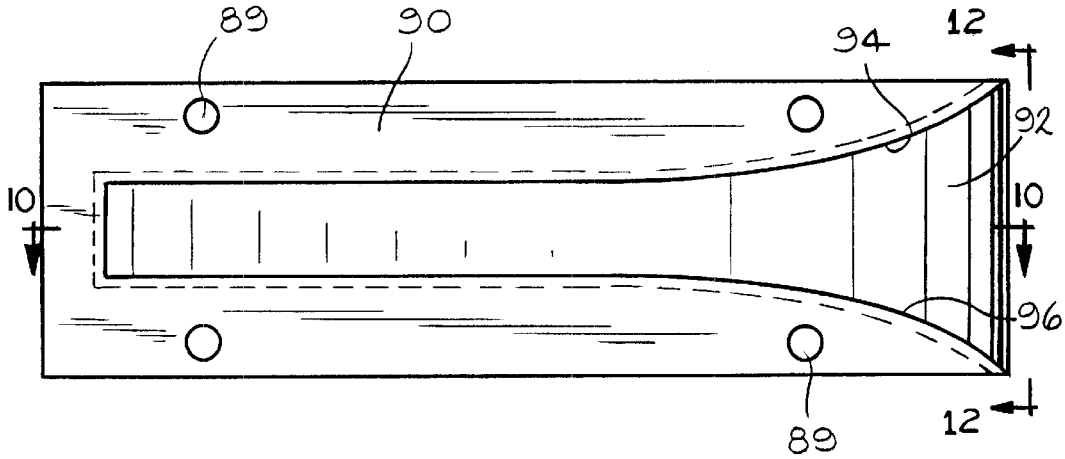
FIG. 11 is a front view of the strand guide insert.
Figure 12:
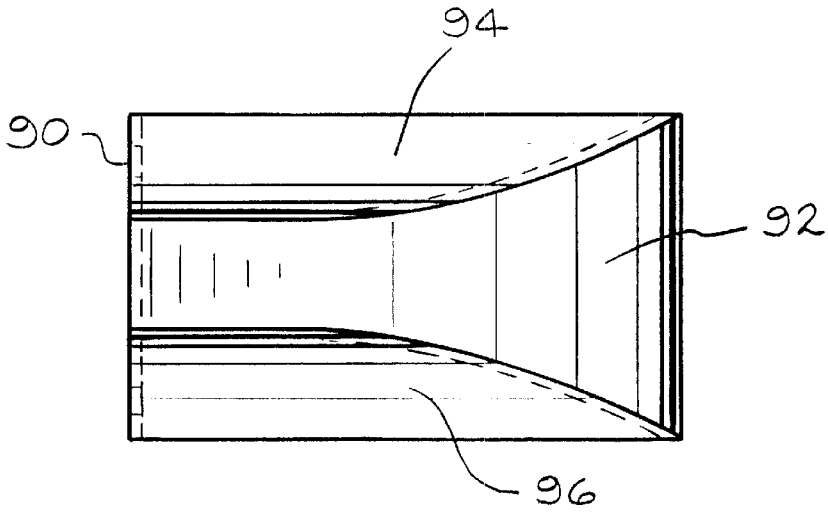
FIG. 12 is an end view of the strand guide insert looking along lines 12—12 of FIG. 11.

The idler roll mount C of the present invention is shown in detail in FIGS. 6–8. A main plate 50 mounts to a frame member 51 of the chopper 3 with bolts 52. An inner protective cover 53 is in between the frame member 51 and the main plate 50. The main plate 50 has an inverted flat bottom U shaped milled out area or depression 54 in the center of a lower end that extends far enough up the main plate 50 to enable the idler roll 8 and assembly to be removed as will be described below. A guide rail 56 is attached to each side of milled out area 54 of the main plate 50 inside the lower portion with bolts 58. An inner end plate 60 slides up and down vertically inside the guide rails 56 and the milled out area 54, but is retained in place horizontally by projections 71 on the guide rails 56. An idler roll axle 62 is mounted rigidly in a hole in the inner end plate 60 with one or more pins 64. The outboard end of the idler roll axle 62 is attached to an outboard end plate 66 with one or more pins 67.

A conventional idler roll working surface layer 65, usually knurled steel and hard chromed, is supported by a core 70 and held in place with an externally tapered end cap 68 on each end with screws 69. The core 70 is supported on the idler roll axle 62 with bearings 72 which are held in place with retainers 74, with or with out seals in a known manner. There is enough clearance between the inner end plate 60 and the guide rails 56 and the main plate 50 to allow the inner end plate 60 to move vertically freely and also to allow the end plate 60 to tilt up or down at least about +/−0.5 degree. This allows the working surface layer 65 of the idler roll 8 to stay in contact with all of the running strands 4 and to remain parallel with the peripheral surface of the back up roll 6 even though it may have a taper, either front to back or back to front, of as much as about 0.030 inch.

The working surface 65 of the idler roll 8 is pressed against the strands 4 on the surface of the back up roll 6 with a fluid cylinder 75. The cylinder 75, preferably an air cylinder, is attached at its upper end to a mounting bracket 76 with a pin 78. The mounting bracket 76 is rigidly attached preferably to the upper end of plate 50. The rod 80 of the cylinder 75 is attached to an arm 82 with a clevis 83 and a quick release pin 84. Preferably, the rod 89 is attached to the arm 82 at a location that either aligns with the center of the back up roll or the center of the idler roll. The arm 82, with or without the end plates 60 and 66, spans the length of the idler roll axle 62 and is attached at one end to the top of the inner end plate 60 with one or more bolts 85 and is attached at the opposite end to the top of the outer end plate 66 with one or more bolts 86. With this arrangement, the cylinder 75 can place a desired force uniformly on the idler roll 8 by adjusting the pressure of the fluid to the cylinder 75 in a known manner. The arm 82 can be integrated with the end plates 60 and 66, if desired, to form a single piece. Also, one or both of the end plates 60 and 66 can be curved to extend back over the surface layer 65 of the idler roll 8 in which case the arm 82 would be shorter than the length of the surface layer 65.

When it is necessary to remove the idler roll 8 the chopper 3 is stopped and the cover guards 17 and 17A are opened or removed. It is not necessary to remove the back up roll 6 to remove the idler roll from the mount C of the present invention. Referring to FIG. 7, after the fluid pressure is removed from the cylinder 75, the quick release pin 84 is removed and the clevis 83 and cylinder 75 are pivoted out and upward and fastened in an out of the way position with a wire, rope or hook (not shown) in a known manner. The idler roll 8 and assembly including the inner floating end plate 60, the arm 82 and the outboard end plate 66 are moved upward in the U shaped milled out area 54 of plate 50 until the bottom of the floating end plate 60 clears the top of the guide rail 56. At this point the idler roll 8 and assembly can be removed outwardly. A new or rebuilt idler roll 8 and assembly can be installed by reversing the removal procedure. With the idler roll 8 mount C of the present invention, the replacement of the idler roll 8 can be accomplished at least as quickly than with prior idler roll mounts. Importantly, the self adjusting feature of adjusting the working surface 65 of the idler roll 8 to a tapered back up roll 6 is retained and the structural alignment and strength of the various components of the idler roll mount C are improved because together they all comprise an integral subassembled unit.

The next feature of the invention, strand guide insert D in FIG. 2, is shown in detail in FIGS. 9–12. In the prior art choppers the new strand 15 passed through the slot 18 in the protective cover guard 17 as it was started up. At the time of starting the new strand 15 into the nips between the idler roll 8 and the back up roll 6 and the blade roll 10 and the back up roll 6, broken fibers and fuzz clumps were generated by the trailing tail of the new strand 15 hitting the edges of the slot as it was pulled away from the nip and through the slot 18. These fuzz clumps would break loose, fall and be thrown into the chopped strand product 14 by the idler roll 8, backup roll 6 and blade roll 10.

The strand guide insert shown in FIGS. 9–12, improvement D, has essentially eliminated this problem. The strand guide insert 88 attaches to the outside or inside of the protective cover guard 17 by any suitable manner, such as with bolts (not shown) passing through an appropriate number of holes 89 in a flange 90 and aligned holes (not shown) in the protective cover guard 17. The strand guide insert 88 is located at the downstream end portion of the slot 18 in the protective cover guard 17.

The strand guide insert 88 is open on the flange side and on a strand entry side or upstream side. The strand guide insert has a curved back face 92 opposite the flange side, a top curved face 94 joining the flange 90 and the curved back face 92 and a bottom curved face 96 joining the flange 90 and the curved back face 92. The top and bottom curved faces 94 and 96 are mirror images of one another. A vertical edge 93 of the curved back face 92 at the entry side of the strand guide insert 88 is several inches away from the outside surface of the protective cover guard 17 while a downstream vertical edge 91 of the curved back face 92 preferably extends outside of the protective cover guard 17 by an amount up to the thickness of the flange 90, but this is not necessary as long as a vertical edge of the slot 18 is ground down or is away from the path of the new strand 15 being started.

The preferred shape of the strand guide insert 88 is shown in FIGS. 9–12. In this preferred embodiment the entry end curved portion of the curved back surface 92 is a 4 inch radius and the remainder of the length is a straight line to the outer surface of the flange 90. The entry end curved portion of the curved top and bottom surfaces 94 and 96 respectively is a 1 inch radius with the remainder of the length being a straight line or a convex surface of a large radius (such as about 13 feet) to the intersection with the curved back face 92. The overall length of the preferred strand guide insert 88 is about 10 inches. Preferably the entry opening height of the curved back face 92 of the strand guide insert 88 is about 3.5 inches and the width of the entry end of the strand guide insert 88 is preferably about 4 inches.

The dimensions of the strand guide insert and the radii of the curved entry portions of the faces can be varied somewhat and the curved faces of the insert 88 can intersect in curved surfaces instead of right angles illustrated in FIGS. 9–12. The essential features of the strand guide insert 88 is that it is located in the downstream end portion of the slot 18 in the protective cover guard 17 and that its inner surfaces present no sharp edges for the new strands to strike as each new strand passes or transitions from inside the protective cover guard 17 coming from the first starting roll 16 or the nip between the idler roll 8 and the back up roll 6 or the nip between the blades 12 of the blade roll 10 and the back up roll 6 the second starting roll 11 outside the protective cover guard 17. With the strand guide insert 88 in place, fuzz generation from the new strands hitting the edges of the slot 18 is eliminated or greatly minimized. Any fuzz that may be generated and collected is eventually carried outside the strand guide insert 88 and thus outside the chopper 3 and does not get into the good product 14. The strand guide insert 88 can be made with one continuous curved working surface on the interior such as if the exit end portions of musical instruments such as a trumpet or trombone were cut in half along their axis. A similar, but half oval shape would also be suitable.

Some chopped strands or portions of chopped strands adhere loosely to the peripheral surface of the back up roll 6 particularly where the blades 12 have cut into that surface of the back up roll 6. Most of these chopped strands or portions of chopped strands that initially adhere to the back up roll 6 are thrown off by the prior art choppers 2 and end up on the floor of the forming room where they present a house keeping problem and become scrap.

It has been discovered that if a deflector plate 98 is placed to have an edge very close to the peripheral surface of the back up roll 6 and above the chopped strand product chute 21, most of the good product adhered to the back up roll 6 that would normally have been thrown on the floor now end up in the good product stream 14. The deflector plate 98 intersects the chopped strands thrown from the back up roll 6 and deflects then into the good product chute 21.

Figure 13:
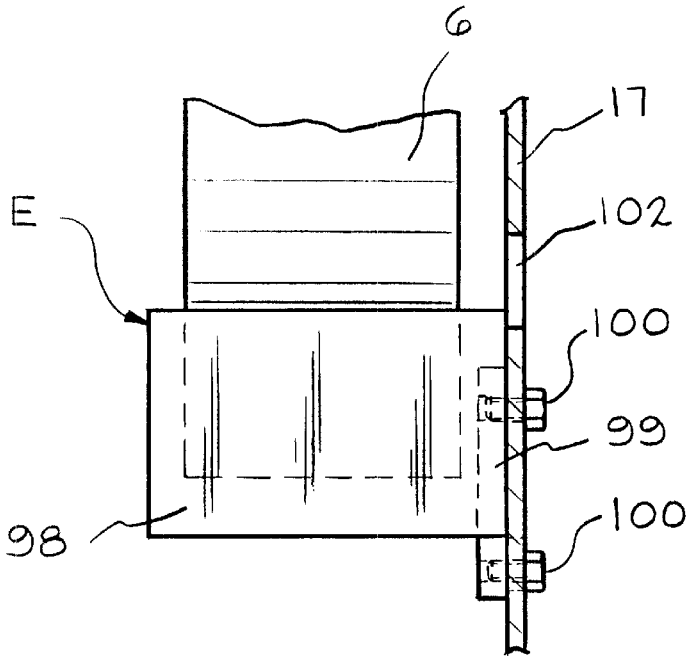
FIG. 13 is a side view of improvement E, an adjustable deflector plate, and portions of the back up roll and protective cover guard of the chopper.

To be most effective in this function, the upper edge of the deflector plate 98 must reside very close to the peripheral surface of the back up roll 6 down stream of the nip between that surface and the blades 12. The diameter of the back up roll 6 changes during the life of the polyurethane working surface portion of the back up roll 6 as it is periodically dressed and turned down to smooth the peripheral surface in a known way. While it is not necessary to move the deflector plate during the life of the back up roll 6, to maintain the most effective clearance between the upper edge of the deflector plate 98 and the peripheral surface of the back up roll 6 during the entire life of the back up roll 6, it is possible to move the deflector plate 98 upward towards the peripheral surface of the back up roll 6 even while the chopper 3 is operating. The preferred way of doing this is shown in FIG. 13, which is to rigidly attach the deflector plate 98 to a bracket 99 and to movably attach the bracket 99 to the inside of the protective cover guard 17 such as with screws 100, preferably thumb screws, that pass through vertical slots in the protective cover guard 17 and enter threaded holes in the bracket 99.

Preferably, a sight hole 102 is placed in the protective cover guard 17 aligned with the top of the deflector plate 98 and the range of the diameters of the back up roll 6 during its life to be able to see the clearance between the top edge of the deflector plate 98 and the peripheral surface of the back up roll 6 while adjusting the deflector plate 98 periodically.

Preferably this clearance is maintained at about one-eighth inch, plus or minus one-sixteenth inch. The clearance can be as much as one-quarter inch and it can be even greater, but more fiber will be lost through this larger gap to fall on the floor.

Other ways of attaching the deflector plate 98 and of adjusting the clearance between its top edge and the surface of the back up roll 6 would be obvious to and within the skill of the artisan and would be suitable to effect the purpose disclosed herein. For example, the deflector plate 98 can be bent 90 degrees along one vertical edge to form a mounting bracket. Also, the deflector plate 98 need not be mounted to the protective cover guard 17 as it can be mounted against the back cover 53 (see FIG. 8 for the back cover) in which case it is adjusted to achieve the desired clearance while chopper is shut down and the protective cover guard 17 is open.

While it is preferred to use all of the five improvements A-E disclosed herein on each chopper to get the best result, each of the improvements A-E can be used independently, or any combination of these improvements can be used, on any one chopper.

What is claimed is:

1. A chopper for chopping fibers and fiber strands, said chopper having a protective cover guard covering a blade roll and a back up roll, the blade roll having blades that work against the back up roll to chop said fiber and fiber strands, said protective cover guard having a slot therein for allowing said fibers or fiber strands to pass from behind said protective cover guard to the outside of said protective cover guard, the improvement comprising a strand guide insert for mounting inside said protective cover guard adjacent a portion of said slot to guide said fibers and fiber strands as they pass through said slot, said strand guide having a strand entry side that is open to said slot to permit a strand to be inserted into the strand guide from the open side, said strand guide also having at least one curved interior surface and no edges that can be contacted by said fibers or fiber strands as they pass through said strand guide insert.

2. The chopper of claim 1 wherein the strand guide comprises:

a) a curved back surface having a curved entry portion and an exit end, said curved entry portion extending from behind said protective cover guard and behind a path said fibers or fiber strands take in a transition from a nip between said blades of the chopper and a surface of said back up roll to a roll located outside said protective cover guard, said exit end extending through said slot in said protective cover guard to be at least flush with the outside of said protective cover guard or beyond, and b) a bottom face and a top face, each having a curved entry portion and an opposite end that reaches the end of said curved back face.

3. The chopper of claim 1 wherein said strand guide insert is brass or stainless steel.

4. The chopper of claim 2 wherein said strand guide insert is brass or stainless steel.

5. The strand guide insert of claim 2, further comprising a flange adjacent said open side.

* * * * *